US006070106A

United States Patent [19]

Hall

[11] Patent Number: 6,070,106

[45] Date of Patent: May 30, 2000

[54] TOOL CARRIAGE DRIVER AND POSITIONING SYSTEM

[76] Inventor: Warren Grimes Hall, 5520 Lockridge Rd., Durham, N.C. 27705

[21] Appl. No.: 08/832,211

[22] Filed: Apr. 8, 1997

Related U.S. Application Data

[60] Provisional application No. 60/015,510, Apr. 16, 1996.

[51] Int. Cl.[7] ..... G05G 11/00

[52] U.S. Cl. ..... 700/95; 212/76

[58] Field of Search ..... 409/85, 93, 103, 409/107, 108, 109, 121, 124, 134, 135, 337–344; 212/76; 490/85, 93, 103, 108, 109, 107, 121, 124, 134, 135, 337, 344; 700/95

[56] References Cited

U.S. PATENT DOCUMENTS

| | | | |
|---|---|---|---|
| 4,346,867 | 8/1982 | Dick et al. | 248/424 |
| 4,364,695 | 12/1982 | Lenz | 409/103 |
| 4,408,740 | 10/1983 | Kleber | 244/158 R |
| 4,423,686 | 1/1984 | Ueno et al. | 108/20 |
| 4,762,298 | 8/1988 | Wood | 248/179.1 |
| 4,995,277 | 2/1991 | Yanagisawa | 74/89.15 |
| 5,022,619 | 6/1991 | Mamada | 248/187.1 |
| 5,040,431 | 8/1991 | Sakino et al. | 74/490.09 |
| 5,145,144 | 9/1992 | Resta et al. | 248/637 |
| 5,165,296 | 11/1992 | Yanagisawa | 74/479.01 |
| 5,207,115 | 5/1993 | Takei | 74/479.01 |
| 5,216,932 | 6/1993 | Takei | 74/479.01 |
| 5,243,893 | 9/1993 | Evans et al. | 83/859 |
| 5,253,834 | 10/1993 | Sullivan et al. | 248/179.1 |
| 5,355,744 | 10/1994 | Yanagisawa | 74/490.09 |
| 5,363,774 | 11/1994 | Anada et al. | 108/143 |
| 5,368,400 | 11/1994 | Cyphert et al. | 400/124.01 |
| 5,445,282 | 8/1995 | Erikkilä | 212/312 |

*Primary Examiner*—William Grant
*Assistant Examiner*—Kidest Bahta
*Attorney, Agent, or Firm*—Rick Martin; Patent Law Offices of Rick Martin, P.C.

[57] ABSTRACT

A cable drive mechanism is provided for causing and controlling movement of a tool carriage in three axis of a large format, light duty, numerically controlled tool suitable for machining goods. The shaft of a carriage-mounted motor serves as a capstan for two opposing loops of a continuous flexible steel cable. Each loop encircles 180 ° of motor shaft after having passed from the carriage to a pulley at one end of the axis and returning, then passing to a second pulley at the same end before passing the length of the axis to a pulley at the opposite end and to the second loop encircling the motor shaft. Such a cable drive system, in conjunction with a control and feedback means, provides an economical means to control movement of the tool carriage in 3 dimensions with accuracy suitable for woodworking with the ability to machine sheet goods such as plywood. The continuous cable loop system with carriage mounted motor provides symmetrical drive power irrespective of the position of the carriage. In an alternate embodiment, data processing system software controls the movement of the tool carriage through computer control of the cable drive mechanism which allows computer control of the manufacturing process.

12 Claims, 7 Drawing Sheets

TOOL CARRIAGE DRIVER AND POSITIONING SYSTEM

CROSS-REFERENCE TO RELATED APPLICATION

This application is a non-provisional application claiming the benefits of provisional application Ser. No. 60/015,510 filed Apr. 16, 1996.

FIELD OF INVENTION

The present invention relates to the field of carriage-positioning systems for numerically controlled tools and more particularly to the use of cable drive systems for driving and positioning tools in the X, Y and Z axes.

BACKGROUND OF THE INVENTION

Industrial grade numerically controlled ("NC") tools have reached a high level of sophistication that has emphasized precision, power, and speed. Such tools have become very expensive. Consequently, there is a need for numerically controlled tools for working wood, soft metals, and plastics that would be suited to small shops and home workshops.

The precision and power of current NC machines comes from drive mechanisms that are rugged and highly machined and that typically take the form of a screw-drive, cog-drive, rack and pinion or gear-drive. These drive systems work well, but are inherently expensive, especially when a work area of more than a few feet square is required. While the current art teaches away from it because of elasticity and lack of precision, an alternative means of providing drive power for the linear motion of carriages in an NC system is the use of a cable drive system.

Previous symmetrical cable drive systems have been limited in the load that can be driven because the cable engaged only a portion of the drive drum (e.g. a single quadrant) or required an override of the cable passing around a pulley. As noted above, cable drive systems requiring multiple turns of cable around a drive drum are limited in precision. This limit of precision is due to the differential stretch in the cable as more or less cable is taken up at opposite ends of the carriage travel.

Representative of the art is U.S. Pat. No. 5,368,400 (1994) to Cyphert et al. which describes a marking apparatus for moving a marking head to coordinate positions utilizing two fixed stepper motors performing in conjunction with a cable and pulley drive system.

U.S. Pat. No. 5,363,774 (1994) to Anada et al. describes an X-Y table assembly wherein a linear relative motion can be provided between the first and second tables in the X-direction and between the second and third tables in the Y-direction.

U.S. Pat. No. 5,355,744 (1994) to Yanagisawa describes a two-dimensional drive system having X guides and X shafts and Y guides and Y shafts.

U.S. Pat. No. 5,253,834 (1993) to Sullivan et al. describes a fixture comprising three plates capable of exercising decoupled motion along three angular axis.

U.S. Pat. No. 5,243,893 (1993) to Evans describes a mechanism for positioning a cutting and punching machine relative to a fixed conveyor comprising a carriage supporting the machine for lateral movement and a support track for lateral movement of the carriage.

U.S. Pat. No. 5,216,932 (1993) to Takei describes an X-Y drive apparatus having an X drive unit mounted on a stationary base and a Y drive unit mounted on an X table of the X drive unit.

U.S. Pat. No. 5,207,115 (1993) to Takei describes an X-Y drive apparatus having a pair of stationary pulleys at opposite ends and a table provided with a pair of moving pulleys.

U.S. Pat. No. 5,165,296 (1992) to Yanagisawa describes a combination of a plurality of moving bodies independently moved by each of the two-dimensional drive systems.

U.S. Pat. No. 5,148,716 (1992) to Suda describes a plane motion mechanism having cables connected to drive units through a tension-applying unit.

U.S. Pat. No. 5,145,144 (1992) to Resta et al. describes an apparatus for moving working units along paths having a gear-motor driven carriage moveable horizontally along guides and a gear-motor driven trolley moveable along guides in a second direction.

U.S. Pat. No. 5,040,431 (1991) to Sakino et al. describes a movement guiding device having hydrostatic gas or bearing members with linear motors used as drive sources in the X and Y stages.

U.S. Pat. No. 5,022,619 (1991) to Mamada describes a positioning device having a pneumatic stage supporting a table and movable in the X and Y directions, a moving device using wire and a lifting device for moving the table vertically.

U.S. Pat. No. 4,995,277 (1991) to Yanagisawa describes a two-dimensional drive system having first and second rods traveling along guides which makes two-dimensional movement of a slider possible.

U.S. Pat. No. 4,762,298 (1988) to Wood describes a support and maneuvering device controllable by movement of controlling means.

U.S. Pat. No. 4,423,686 (1984) to Ueno et al. describes a table apparatus having a stacked array of independently driven upper and lower slides driven by a rotation transmission mechanism.

U.S. Pat. No. 4,408,740 (1983) to Kleber describes an apparatus for acceleration-free mounting of a body in a spacecraft having a three axis driving means controlled by scanning units.

U.S. Pat. No. 4,364,695 (1982) to Lenz describes a carving machine with an auxiliary frame having individual motors driving carving tools.

U.S. Pat. No. 4,346,867 (1982) to Dick et al. describes a transport mechanism for an ultrasonic scanner having cables controlling its angular velocity and phase.

All of the prior art machines are very complex and expensive. Each requires very accurately machined parts in order to operate properly. None of the machines is suited for the hobbyist with a modest shop. The present invention solves these problems by providing an accurate yet inexpensive driver and positioning device for the home-shop owner. It can be constructed of readily available materials and yet can operate with repeatable and precise accuracy.

SUMMARY OF THE INVENTION

The primary aspect of the present invention is to provide a simple and reliable cable drive system for the movement of and positioning of a tool carriage in a numerically controlled device.

Another aspect of the present invention is to provide a carriage drive system (generally called a linkage) of minimal components which, in conjunction with a feedback means for monitoring position, can provide an accurate yet very inexpensive method of positioning the weight of a tool carriage along a linear guideway over a distance of many feet.

Another aspect of the present invention is to provide a drive in which stretch of a drive cable and related error is relatively consistent throughout the range of possible tool carriage positions.

Another aspect of the present invention is to provide for a simple and reliable transfer of drive power from a motor to the cable system.

Another aspect of the present invention is to provide an efficient transfer of power from motor to cable in a manner that requires no gearing, pulleys, drums, or axles other than a simple sleeve on the motor shaft itself.

Another aspect of the present invention is to provide a transfer of power from motor to cable in a manner such that the shaft is fully engaged by the cable to maximize the efficiency of the drive and yet in which the cable need not move up and down the shaft with turns nor awkwardly overlap itself.

Another aspect of the present invention is to provide a transfer of power from motor to cable drive in a manner which limits the amount of unbalanced lateral tension placed on the shaft by the cable system.

Other aspects of this invention will appear from the following description and appended claims, reference being made to the accompanying drawings forming a part of this specification wherein like reference characters designate corresponding parts in the several views.

The present invention is a cable-driven numerically controlled cutting tool. It comprises a plurality of carriages and guideways in the X, Y and Z axes. The X and Y axis carriages each have an optical rotary encoder. A cable is attached to each carriage in such a manner so as to enable controlled movement of the carriage. A drive motor(s) on each carriage operates as a capstan which travels along the cable causing the carriage to travel along a guideway. A second carriage supporting the tool carriage also has motors which allow the second carriage to travel along a guideway. Each guideway has an optical rotary encoder communicating with a computer. The optical rotary encoders provide feedback to the computer as to the position of the carriage on the guideway. The motors are stepping or servo motors which are controllable by computer. The third axis of motion of the cutting tool is enabled by a motor operating to cause the cutting tool to move vertically on the tool carriage. The position of the cutting tool is determined and maintained by the commands from the computer to the various stepping or servo motors and by feedback from the optical rotary encoders.

The carriage positioning system is simplified and economical when compared to the prior art because it is built as a set of similar frames with attached wheels. One frame axis rides on the other. It is inexpensive relative to other systems because the carriage frame of the X axis also serves as the track of the Y axis. In addition, all structural junctions and all movement and wheel arrangements are identical throughout the tool. The frames and carriages may be constructed of the same materials (U shaped channels and tubular materials as shown in FIG. 3). The proportions of the frames can be pre-set during construction for ease of assembly. For example, the tool may be of dimensions four feet by four feet in the X and Y axis To achieve good stability between each set of guideways without resorting to an expensive bearing system, the tool has grooved wheels that engage each guideway at an angle and are relatively widely spaced on each carriage. This spacing is roughly proportional to the distance spanned on that axis. The Z axis is built with a similar carriage and rolling arrangement. The motors are mounted on an inside member of each frame. The wheels are mounted on an outside member.

The modular nature of the device allows individual carriage positioning systems to be fit and adjusted at the time of assembly. No precise measurement or fine machining of parts is required during fabrication of the parts because the fit and alignment between components is effected at the time of assembly.

A further feature of this modular structure is the method used to achieve the angled mount of the rolling wheels. Each carriage comprises a pipe which is bolted to the frame. Wheels are then mounted on this pipe at 45 degrees to the guideway. From an assembly point of view, this is a very simple piece to manufacture since it simply requires drilling four holes, two at 45 degrees to the other two in order to achieve the desired arrangement for bolting the pipe to the frame and bolting the wheels to the pipe. No special brackets need to be machined, and the shape of the pipe provides additional rigidity to the frame.

Figure 1:
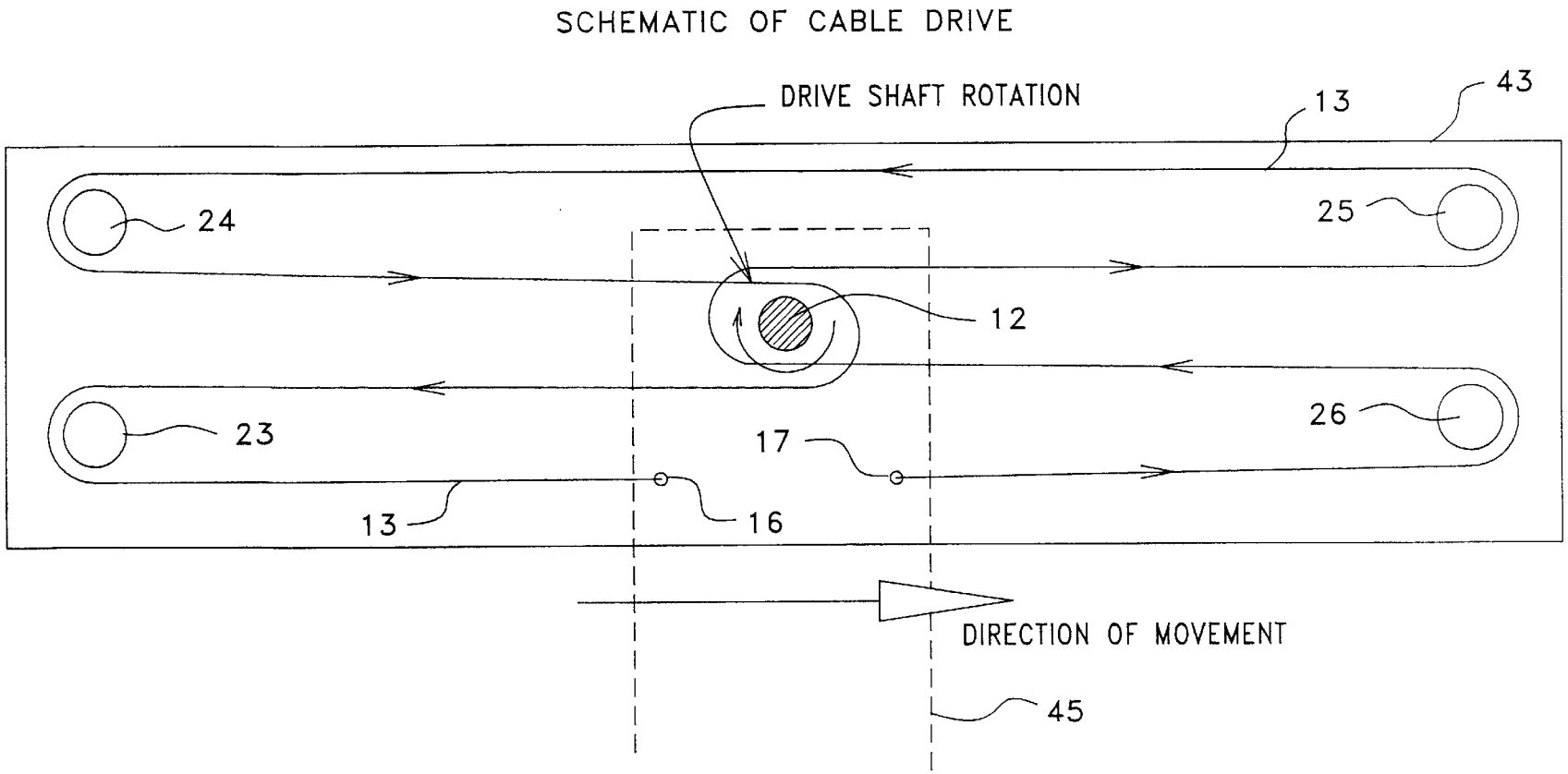
FIG. 1 is a plan view schematic representation of the cable drive system showing the arrangement of cable, carriages pulleys and motor.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

KEY

12. Motor shaft
13. Flexible cable
14. Flexible cable
15. Flexible cable
16. Attachment point
17. Attachment point
18. Pulley
19. Pulley
21. Pulley
22. Pulley
23. Pulley
24. Pulley
25. Pulley
26. Pulley
28. Motor
29. Motor
30. Motor
31. Motor
33. Pulley

34. Pulley
35. Pulley
36. Pulley
42. X-axis guideway
43. X-axis guideway
44. X-axis frame
45. X-axis frame
46. X-axis carriage
47. X-axis carriage
52. Y-axis guideway
53. Y-axis guideway
54. Y-axis frame
55. Y-axis frame
56. Y-axis carriage
57. Y-axis carriage
58. Y-axis frame
59. Motor mount
60. Z-axis guideway
61. Z-axis guideway
62. Z-axis carriage
64. Z-axis drive mechanism
66. Tool carrier
67. Grooved wheel
68. Tool
70. Cutting bit
81. Optical rotary encoder
82. Optical rotary encoder
90. Motor shaft
91. Motor shaft

DESCRIPTION OF THE PREFERRED EMBODIMENT

Figure 3:
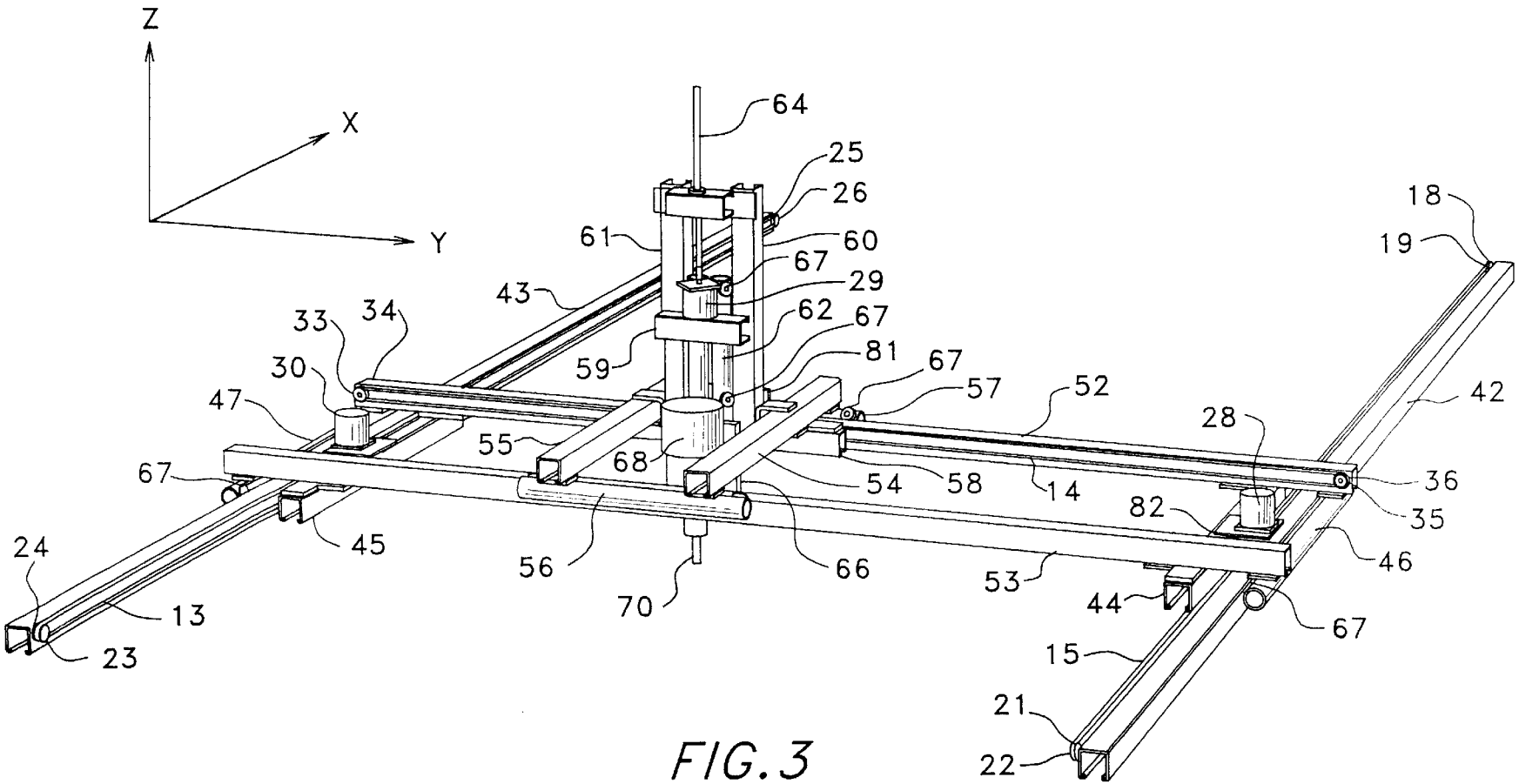
FIG. 3 is a perspective view of the multi-axis numerically controlled tool, the preferred embodiment.

FIG. 1 in a plan view schematic representation of the cable drive system showing the arrangement of certain components. A plurality of cable drive systems is used to move the carriages in each dimension as depicted in FIG. 3. Flexible cable 13 is attached to x-axis frame 45 at attachment point 16. It loops continuously through the drive system to attach on the opposite end of x-axis frame 45 at attachment point 17. The preferred material for flexible cable 13 is a thin, plastic-covered, multi-strand stainless steel cable. Drive power may also be conveyed by a flexible chain (not shown) in place of flexible cable 13 with a double sprocket (not shown) mounted on motor shaft 12 for power transfer. Flexible cable 13 is routed from attachment point 16 to a freely turning pulley 23 that is rigidly mounted at one end of x-axis guideway 43. After circling pulley 23, flexible cable 13 returns towards a-axis frame 45 and makes a 180° loop around motor shaft 12 before continuing to pulley 24 adjacent to pulley 23. From pulley 24 flexible cable 13 runs to pulley 25 at the opposite end of x-axis guideway 43. From pulley 25 flexible cable 13 returns to x-axis frame 45 and makes a 1800 loop around motor shaft 12. Flexible cable 13 continues to pulley 26 then returns to x-axis frame 45 to attach at attachment point 17.

This embodiment shows a pulley system in which a mechanical advantage of 2:1 is achieved. Additional sets of pulleys (not shown) with additional pairs of pulleys to return the flexible cable from the carriage would, with the use of an increased length of continuous flexible cable, create an increased mechanical advantage.

Figure 2:
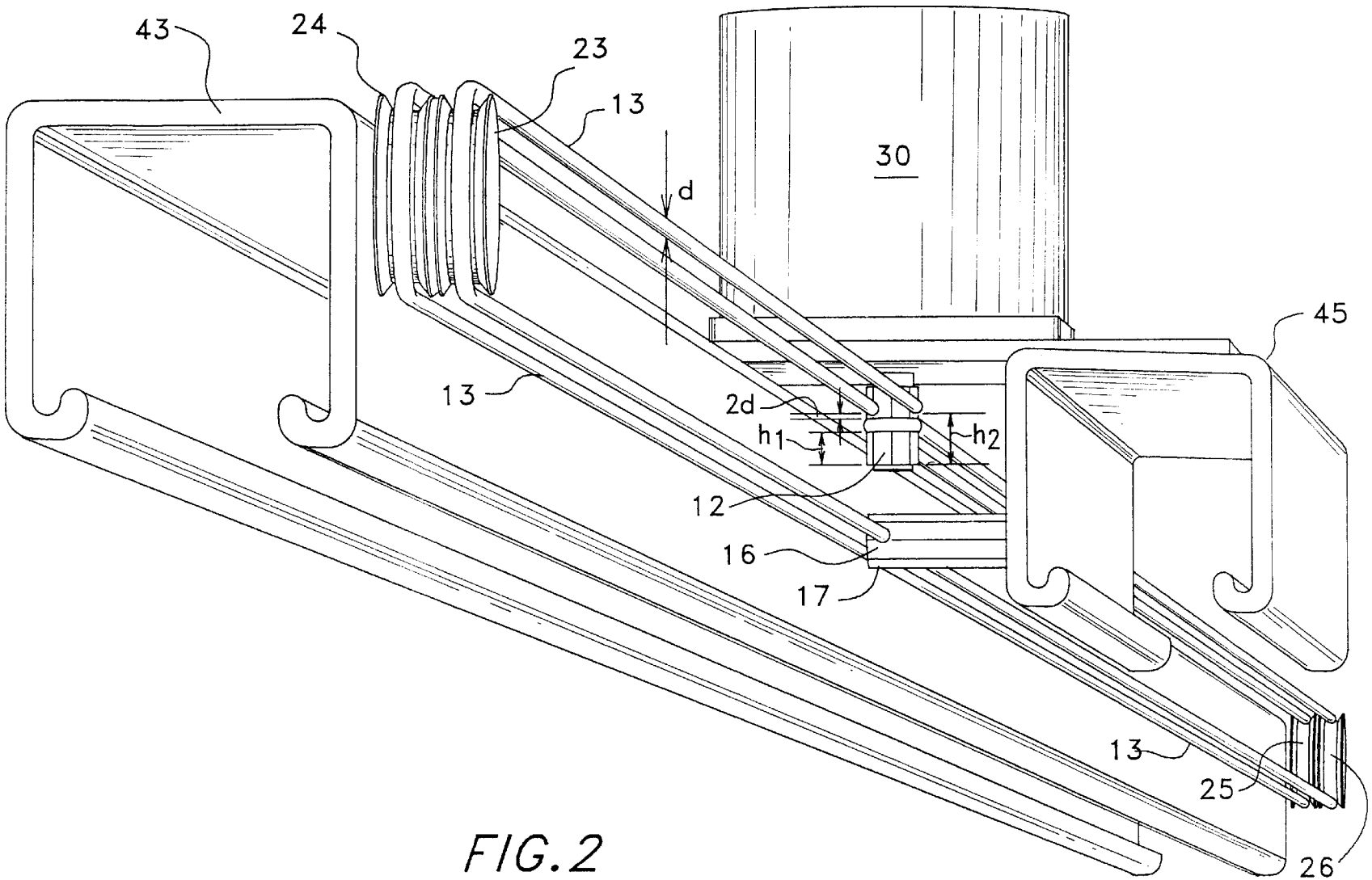
FIG. 2 is a perspective view of a cable drive system that shows the adjacent positioning of the cable overlaps on the motor shaft.

FIG. 2. shows a perspective view of a cable drive system for positioning x-axis frame 45 along x-axis guideway 43. A plurality of such carriages and drive systems as depicted in FIG. 3 is used to achieve movement of the tool in 3 dimensions. Motor 31 and motor 28 each through motor shaft 90 and motor shaft 91 respectively, travel along flexible cable 14 and flexible cable 15, respectively, in a manner identical to that depicted in FIG. 2 for motor 30. X-axis frame 45 moves on the x-axis guideway 43 on bearings or grooved wheels 67 (not shown). Motor 30 is shown mounted vertically on the x-axis frame 45 with motor shaft 12 extending through and below the x-axis frame 45. Motor shaft 12 is encased in a thin semi-flexible covering material (not shown). Flexible cable 13 loops are positioned about motor shaft 12 at slightly different heights through 180° from each direction as depicted in FIG. 1, at height $h_1$, and height $h_2$, typically separated by twice their diameter, 2d. Pulley 23 and pulley 24 are staggered in height relative to pulley 25 and pulley 26 by this same distance 2d in order to maintain the proper position of flexible cable 13 on motor shaft 12. Motor 30 is actuated by commands from the computer (not shown) which causes motor shaft 12 to turn in a controlled manner. Rotation of motor shaft 12 causes motor 30 to move along the length of flexible cable 13.

FIG. 3 is a perspective view of the multi-axis numerically controlled tool. In this view, x-axis carriage 46 and x-axis carriage 47 move on grooved wheels 67 along parallel x-axis guideway 42 and x-axis guideway 43 to provide movement in the x-axis. Motor 30 is mounted on x-axis frame 45. Motor 30 travels along flexible cable 13 as described in FIG. 1 and FIG. 2. Flexible cable 13 is routed through pulley 23, pulley 24, pulley 25, and pulley 26 as depicted in FIG. 1. Motor 28 is mounted to x-axis frame 44. Motor 28 travels along flexible cable 15 as generally depicted in FIG. 1 and FIG. 2 for motor 30. Motor 28 and motor 30 are operated in a coordinated manner by the computer (not shown) in order to allow motion of the x-axis carriage 46 and x-axis carriage 47 in a coordinated manner. Flexible cable 15 is routed through pulley 18, pulley 19, pulley 22, and pulley 21 as depicted in FIG. 1 for flexible cable 13. X-axis frame 44 and x-axis frame 45 provide rigidity to the frame and are mounted to y-axis guideway 52 and y-axis guideway 53. An alternate embodiment (not shown) for the second carriage on an axis receives power in a yoked manner by a secondary cable system, or by a separate motor and cable-drive on the second carriage.

Y-axis frame 54 and y-axis frame 55 and y-axis frame 58 are mounted on y-axis carriage 56 and y-axis carriage 57. Y-axis carriage 56 and y-axis carriage 57 move on grooved wheels 67 along the y-axis guideway 52 and y-axis guideway 53 to provide movement in the y-axis. Movement of the y-axis frame is caused by operation of motor 31 as described typically in FIG. 1 for motor 30. Motor 31 is mounted in y-axis frame 58 and travels along flexible cable 14.

Grooved wheels 67 are mounted on z-axis carriage 62. Z-axis carriage 62 moves on z-axis guideway 60 and z-axis guideway 61 to provide movement of the tool 68 in the z-axis. Tool 68 is attached to tool carrier 66 which is in turn attached to z-axis carriage 62. The tool may be a router, drill, or circular saw. The tool 68 may have a cutting bit 70. Movement in the z-axis is accomplished by operation of the z-axis drive mechanism 64 with motor 29 by computer command. Motor 29 is mounted on motor mount 59.

Motor 28, motor 29, and motor 30 are stepper motors but could be servo motors or any motor capable of being accurately controlled by a computer. A known stepper motor is capable of 400 steps per inch. The routing of flexible cable 14 and flexible cable 15 is identical to that depicted in FIG. 1 for flexible cable 13.

A position feedback means provided by optical rotary encoder 81 and optical rotary encoder 82 is used to provide information electronically to the computer about the movement and position of the carriages in order to insure precision control of the tool.

Figure 6:
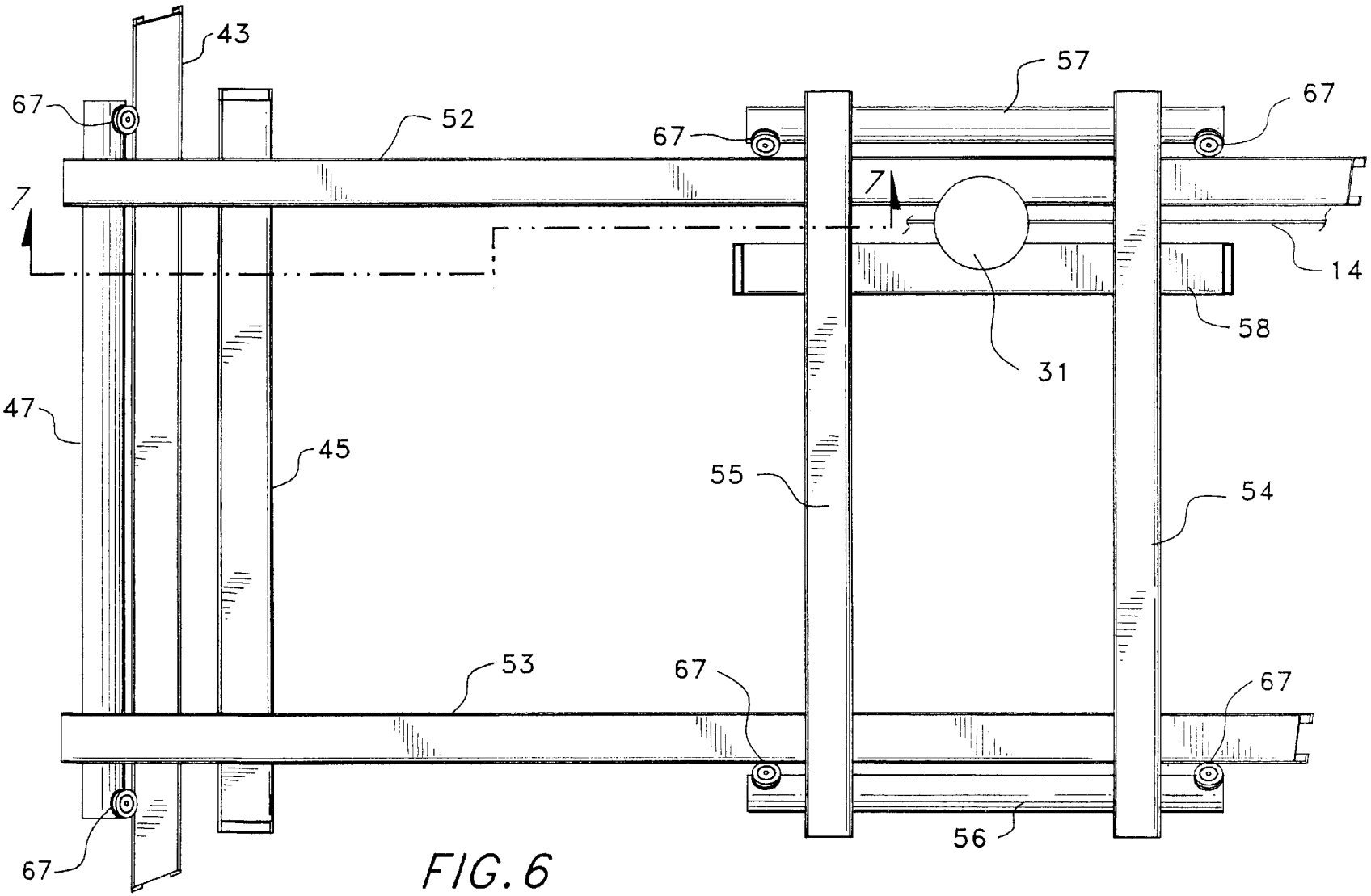
FIG. 6 is a top view of the frame.

Referring to FIG. 6, a top view of the frame, the relationship between the various carriages is shown. Grooved wheels 67 mounted on x-axis carriage 47 roll along the edge of x-axis guideway 43. Y-axis carriage 57 supports grooved wheels 67 and y-axis carriage 56 support grooved wheels 67. Grooved wheels 67 run on y-axis guideway 52 and y-axis guideway 53. Y-axis frame 55 mounts on y-axis carriage 57 and y-axis carriage 56. Motor 31 travels along flexible cable 14 to cause the movement of the tool 68 (not shown) in the y-axis.

Figure 7:
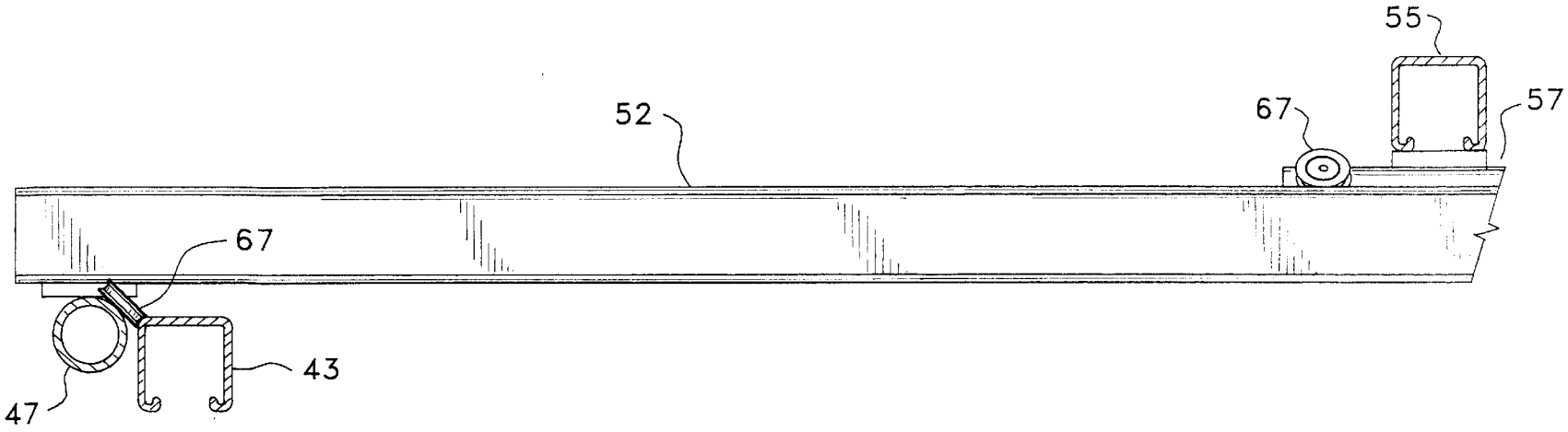
FIG. 7 is a sectional front view A—A of the frame.

FIG. 7 is a sectional front view A-A of the frame. Grooved wheels 67 are mounted to x-axis carriage 47. Grooved wheels 67 roll along the edge of x-axis guideway 43. Y-axis guideway 52 mounts to x-axis carriage 47. Grooved wheels 67 mount to y-axis carriage 57. Grooved wheels 67 roll along the edge of y-axis guideway 52. Y-axis frame 55 mounts on y-axis carriage 57.

The x-axis is no set length as compared to the length of the y-axis. Guideways are rigid tubing on which carriages ride. Guideways and carriages may be constructed of the same materials such as unistrut which is known.

While the preferred embodiment shows the cable, pulleys, and shaft drive all in a common horizontal plane, cable, pulleys, and drive may be vertically oriented, oriented at an angle, or oriented in various combinations.

Figure 4:
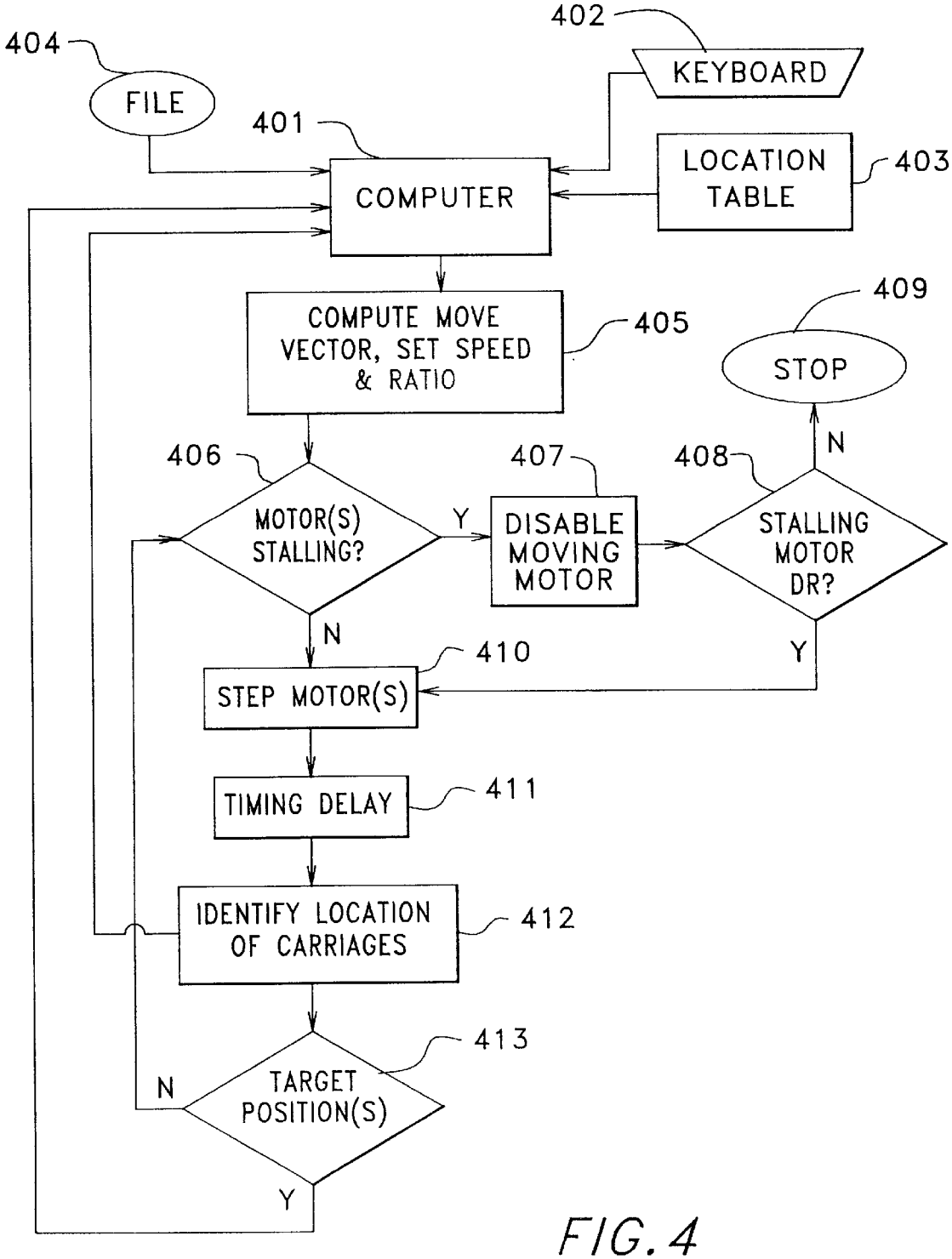
FIG. 4 is a logic flow chart of the procedure used to control the movement and position of the tool.

FIG. 4 is a logic flow chart of the procedure used to control the movement and position of the tool.

Description of the Computer

The controller/driver board described accepts input from the parallel port (Centronics® format) of a PC-type computer. Since the information transfer process is serial, it is relatively straightforward to add an additional conversion stage so that the controller/driver will accept standard serial format input and send feedback information back to any microcomputer device. Such converters are available commercially as in-line, stand-alone devices, or they could be built into the controller/driver. They will allow the use of the carriage positioning system with virtually any computer to which the relatively generic software can be conveniently converted.

Description of the Software

The source code provided has been written in the Visual Basic® for DOS (Microsoft®) language. It is compiled to an executable form using the Visual Basic® for DOS compiler (Microsoft®). The source code utilizes standard subroutines for file I/O, screen displays, and editing functions that are licensed with the Visual Basic® for DOS compiler.

When compiled, the executable program will run on any PC utilizing one of the Intel® 8086 family of chips (or compatibles) and operating under the Microsoft® DOS operating system for microcomputers. However, to drive the carriage positioning system at appropriate speeds, an Intel® 80286 or higher chip is required.

Description of the Logic

In the stand-by state, the tool carriage awaits movement instructions from the computer as input to the computer by the operator (input block 402). The software maintains a continuous record of the tool's position by feedback from the optical rotary encoders (functional block 412) and monitors possible location changes (that might be produced manually or as a result of accidental jarring) in its stand-by state. Instructions are either directly entered from the computer keyboard (input block 402) by an operator or are read from a computer file (input block 404).

A movement command is received from the operator as XY(Z) coordinates by the computer (functional block 401). Input units from the operator (input block 402) are converted to arbitrary machine units by the computer. Requested movement speed is calculated by the computer, and the ratio of movement between the primary and secondary and tertiary axes is determined (functional block 405). This ratio determines ratios of motor steps.

The movement/step loop is then entered. In each movement cycle, if no stalling is occurring (test block 406), the primary axis motor will always step and the secondary (and tertiary) motor will also step if appropriate in terms of the ratio of steps in that axis to steps in the primary axis (functional block 410). If the slipping is severe (test block 408) movement of the motor is aborted by the computer and the operator alerted (functional block 409). This determination is made at the beginning of each cycle after checking for possible stalling or slipping of each carriage motor (test block 406). If the actual location of the tool is slipping behind the expected location in one axis, the movement of the tool in the other axis (or axes) is disabled (functional block 407) until the slipping axis catches up (test block 408). In this way, relatively accurate movement of the tool is assured, even in cases where the cable drive may slip or stretch slightly. The motor step value for each axis is converted by the computer to the appropriate values for positioning the motor coil based on values in a look-up table contained in the RAM memory of the computer(input block 403). Because the data lines are multiplexed, the outputs to the motors are transmitted sequentially, though this transmission requires only microseconds.

Following the transmission of motor step signals (functional block 410), the location of each carriage according to each optical rotary encoder is polled from the port through the control board (functional block 412). Carriage movements are decoded using a lookup table contained in the RAM memory of the computer (input block 403). These movement readings are used by the computer to compute the new location of the tool (functional block 405).

At this point, the location of the tool is checked against its expected location as computed in terms of the number of steps that have been taken by each motor and the known movement of each motor that should result from the number of steps that have been taken and the known movement that is the result from this number of steps (functional block 410).

Movement continues until the target location as entered by the operator are reached in each axis (test block 413). Then the movement loop is exited and the next vector in the file is read or control returned to the operator at the computer keyboard (functional block 401).

The program loops through feedback and location computation to cause a timing delay (functional block 411) that produces defined intervals between motor step commands and thus allows for the control and determination of carriage movement and speed.

Figure 5:
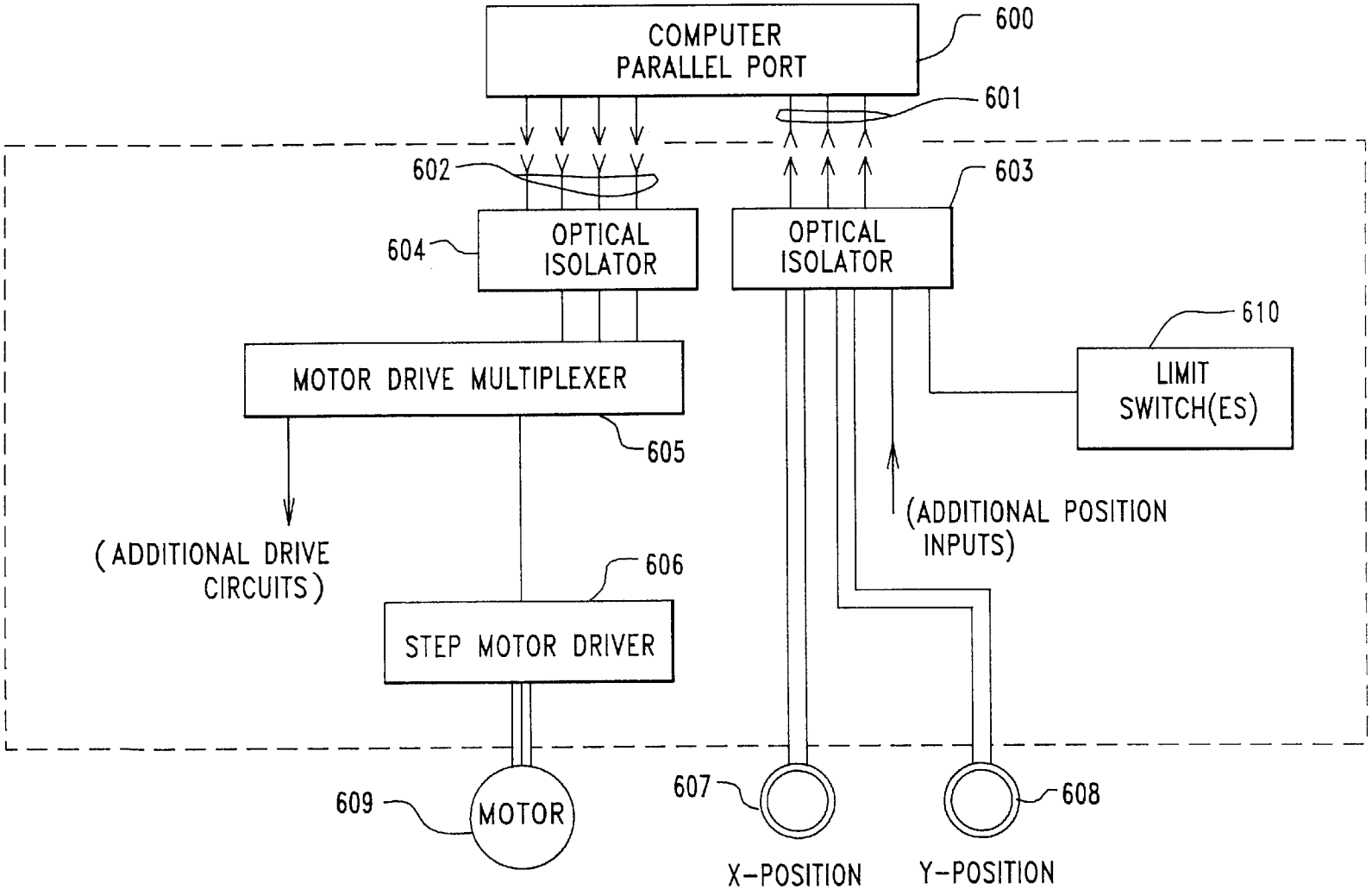
FIG. 5 is a schematic which depicts the controller/driver board in the computer.

FIG. 5 is a schematic which depicts the controller/driver board in the computer. The controller/driver board receives input from the computer via the parallel port interface 600. Information coming to the controller/driver board on data lines 601 passes through opto-isolator 603 that serves to protect the computer from any surges from the motor circuitry. Data lines 602 relay the information that controls the multiplexer 605 and sets the channel for the designated motor 609. Data lines 602 also contain the information that activates the appropriate coils of the designated motor 609 for its next position by enabling or disabling current flow through the step motor driver 606. Step motor driver 606 is one of several standard IC's that conveniently control high current outputs to step motors (of either the "L/R" or "PWM/Chopper" type). Each step motor driver 606 also could be assembled from individual components.

Feedback to the computer is provided over data lines 601 (typically designated "status" and "control" channels). For protection of the computer, these signals pass through opto-isolator 603 before going to the parallel port interface 600. The encoder 607 for X axis feedback and the encoder 608 for Y axis feedback each provide movement information in a standard quadrature format that is then decoded for location by the computer. Other input lines serve limit switches 610 and other accessory functions.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A tool carriage comprising:

a pair of parallel stationary x-axis guideways;

a pair of movable x-axis carriages each having a wheel engaged along a respecting stationary x-axis guideway;

a first motor mounted on a movable x-axis frame and connected to an x linkage to move the movable x-axis carriage along the x-axis guideway;

a structural junction for the pair of stationary x-axis guideways comprising a pair of parallel y-axis guideways each connected to movable x-axis frame, wherein at least one y-axis guideway has a y linkage;

a pair of movable y-axis carriages each having a wheel engaged along a y-axis guideway;

a pair of movable y-axis frames attached to the movable y-axis carriages;

a second motor mounted on a y-axis frame and connected to the y linkage to move the y-axis carriage along the y-axis guideway;

said x and y axis guideways and said x and y axis frames all constructed from a common channel material:

said x and y axis carriages all constructed from a common tubular material; and wherein a pair of x-axis carriage and frame assemblies serve as a pair of y axis guideway supports.

2. A tool carriage comprising:

a pair of parallel stationary x-axis guideways;

a pair of movable x-axis carriages each having a wheel engaged along a respective stationary x-axis guideway;

a first motor mounted on a movable x-axis frame and connected to an x linkage to move the x-axis frame along the x-axis guideway;

a structural junction for the pair of stationary x-axis guideways comprising a pair of parallel y-axis guideways each connected to the movable x-axis frame, wherein at least one y-axis guideway has a y linkage;

a pair of movable y-axis carriages each having a wheel engaged along a y-axis guideway;

a pair of movable y-axis frames attached to the pair of movable y-axis carriages;

a second motor mounted on a movable y-axis frame and connected to the y linkage to move the y-axis frame along the y-axis guideway;

a structural junction for the pair of y-axis frames comprising a pair of parallel z-axis guideways each connected to a y-axis frame;

a third motor mounted on a z-axis frame to move a tool mounted on a z-axis frame;

said x, y, and z axis guideways and said x, y, and z axis frames all constructed from a common channel material;

said x, y axis carriages all constructed from a common tubular material; and wherein a pair of x-axis carriage and frame assemblies serve as a pair of y axis guideway supports.

3. The tool carriage of claim 1, wherein the motors are dc stepping motors.

4. The tool carriage of claim 2, wherein the motors are dc stepping motors.

5. The tool carriage of claim 1, wherein said wheels each further comprise grooves.

6. The tool carriage of claim 2, wherein said wheels each further comprise grooves.

7. The apparatus of claim 1, wherein said x and y axis guideways further comprise U shaped sections.

8. The apparatus of claim 2, wherein said x, y, and z axis guideways further comprise U shaped sections.

9. The apparatus of claim 1, wherein the x and y linkages each further comprise cabling.

10. The apparatus of claim 2, wherein the x and y linkages each further comprise cabling.

11. The apparatus of claim 1, wherein the x-axis carriage is a pipe bolted to the x-axis frame, and the y-axis carriage is a pipe bolted to the y-axis frame.

12. The apparatus of claim 11, wherein each of the x and y axis wheels further comprise wheels mounted at a 45° angle to the pipe.

* * * * *